US009497555B2

(12) United States Patent
Beck

(10) Patent No.: US 9,497,555 B2
(45) Date of Patent: Nov. 15, 2016

(54) IMPLANTABLE MIDDLE EAR TRANSDUCER HAVING IMPROVED FREQUENCY RESPONSE

(75) Inventor: John P. Beck, Savage, MN (US)

(73) Assignee: Envoy Medical Corporation, St. Paul, MN (US)

( * ) Notice: Subject to any disclaimer, the term of this patent is extended or adjusted under 35 U.S.C. 154(b) by 2286 days.

(21) Appl. No.: 12/259,258

(22) Filed: Oct. 27, 2008

(65) Prior Publication Data

US 2010/0042183 A1 Feb. 18, 2010

Related U.S. Application Data

(60) Provisional application No. 61/089,522, filed on Aug. 16, 2008.

(51) Int. Cl.
*H04R 25/00* (2006.01)

(52) U.S. Cl.
CPC ..... *H04R 25/606* (2013.01)

(58) Field of Classification Search
CPC H04R 25/606; H04R 25/00; H04R 2460/13; H04R 2225/67; H04R 3/002; A61N 1/36032; A61F 2002/183; A61F 2/18; A61F 2/02
USPC ..... 600/25; 607/2, 55–57; 84/DIG. 24; 128/897–899
See application file for complete search history.

(56) References Cited

U.S. PATENT DOCUMENTS

| | | | | |
|---|---|---|---|---|
| 6,075,870 | A * | 6/2000 | Geschiere et al. | 381/417 |
| 6,940,989 | B1 * | 9/2005 | Shennib et al. | 381/326 |
| 2004/0264725 | A1 * | 12/2004 | Madsen et al. | 381/328 |
| 2006/0058573 | A1 * | 3/2006 | Neisz et al. | 600/25 |
| 2007/0083078 | A1 * | 4/2007 | Easter et al. | 600/25 |
| 2008/0004486 | A1 * | 1/2008 | Andrews et al. | 600/25 |
| 2009/0247813 | A1 * | 10/2009 | Parker | 600/25 |

* cited by examiner

*Primary Examiner* — Navin Natnithithadha
*Assistant Examiner* — Sunita Reddy
(74) *Attorney, Agent, or Firm* — Crig Taylor Law Office, PLLC

(57) ABSTRACT

Apparatus, systems, and methods having or using an improved implantable middle ear transducer for driving an ossicular chain bone to assist in aiding hearing. One embodiment of the present invention is a transducer assembly for converting electrical signals to mechanical vibrations which can be coupled, for example, to the stapes to provide audible frequency vibrations to the cochlea. One transducer assembly includes a pair of fins or gussets coupled to opposite sides of a transducer in the direction of unwanted movement of the transducer. The base of the transducer may be coupled to a base member while the fins have free edges that are near to but not coupled to the base member. Some fins are triangular shaped. The fins may not substantially inhibit vibration in the preferred plane, but can inhibit unwanted vibrations in a plane orthogonal to the preferred direction which can substantially include a plane containing the fins.

15 Claims, 8 Drawing Sheets

IMPLANTABLE MIDDLE EAR TRANSDUCER HAVING IMPROVED FREQUENCY RESPONSE

RELATED APPLICATIONS

The present application is a non-provisional of U.S. Provisional Patent Application No. 61/089,522, filed Aug. 16, 2008, titled IMPLANTABLE MIDDLE EAR TRANSDUCER HAVING IMPROVED FREQUENCY RESPONSE, herein incorporated by reference in its entirety.

TECHNICAL FIELD

The present invention is related generally to implantable medical devices. More specifically, the present invention is related to implantable transducers, which can be used in partial middle ear implantable or total middle ear implantable hearing aid systems.

BACKGROUND

In some types of partial middle ear implantable (P-MEI) or total middle ear implantable (T-MEI) hearing aid systems, sounds produce mechanical vibrations within the ear which are converted by an electromechanical input transducer into electrical signals. These electrical signals are in turn amplified and applied to an electromechanical output transducer. The electromechanical output transducer causes an ossicular bone to vibrate in response to the applied amplified electrical signals, thereby improving hearing.

An electromechanical transducer used for the purpose of vibrating or sensing from any or all elements of the ossicular chain may be mounted in or near the middle ear. The transducer is generally contained in a housing or enclosure, forming a driver or sensor assembly that facilitates the placement of the transducer within the middle ear.

In previous designs, applicant has noticed unwanted resonances within the audible frequency range, which can be disconcerting to the person having the implant.

What would be desirable are transducers which more accurately convert the electrical signal received into vibrations which can be coupled to the ossicular chain.

SUMMARY

Some embodiments of the present invention provide an implantable transducer assembly for implanting into a middle ear region, the transducer assembly including an elongate transducer adapted to receive an electrical signal and produce a vibration in response to the electrical signal, in which the vibration occurs substantially in a first plane which extends through the transducer. The transducer can have a length, a free vibrating end, and a base region opposite the free end for operable coupling to a bone. The transducer can also have a pair of fins operably coupled to the transducer base region, the fins having a thickness dimension, and in which the fins lie substantially in a second plane which is normal to the first plane.

Some transducer assembly embodiments also have a protective layer covering the transducer, in which the fins are not directly coupled to the transducer, and in which the fins are secured to the protective layer, such that the operable coupling is made through the protective layer. Some transducer assemblies may have a base member, in which the transducer base region is coupled to the base member, and in which the fins are not directly coupled to the base member, such that the vibrating in the first plane moves the fins in a direction orthogonal to the fin thickness dimension.

Some transducer assembly embodiments have a base member, in which the transducer base region is coupled to the base member, and in which the fins each have a free edge disposed near the base member, such that the vibrating in the first plane moves the fins in a direction orthogonal to the fin thickness dimension. In some embodiments, the protective layer includes a metallic sheet, which may be formed of titanium less than about 3 mils thick. Some fins may be triangular shaped, others may have a nominal triangular shape but with convex outer edges, some others may have a nominal triangular shape but with concave outer edges, and still others may have rounded outer edges.

Some fins have a length at least about 20 percent of the length of the transducer, and some may have a length less than about 80 percent of the length of the transducer. In some embodiments, the fins have a length of less than about ½ inch. The transducer is less than about 1inch long in some embodiments. Some transducer assemblies also include a biocompatible bone mount assembly coupled to the transducer base for securing to a bone. In some embodiments, the transducer is hermitically sealed.

The present invention also includes systems for treating hearing loss, the systems comprising all the systems described herein and combinations thereof.

Methods are also provided for aiding hearing. One method includes receiving an acoustic signal near a human ear; converting the acoustic signal to an electrical signal; transmitting the electrical signal to a vibratory transducer; and vibrating the transducer in a first plane responsive to the received electrical signal. The vibration can be attenuated in a second plane orthogonal to the first plane by a pair of fins disposed substantially in the second plane where the fins are operably coupled to the vibratory transducer. In one method, the transducer is coupled to a base member, and the fins are not directly coupled to the base member, such that the vibrating in the first plane moves the fins with respect to the base member. In one embodiment method, the transducer is coupled to a base member, and the fins have free edges not coupled to the base member, such that the vibrating in the first plane moves the fins with respect to the base member, such that the fin edges near the base member are free to move in the second plane relative to the base member. In one method, the transducer is covered by a protective layer, and the fins are secured to the protective layer, such that transducer vibrations are transmitted through the protective layer.

DETAILED DESCRIPTION

Figure 1:
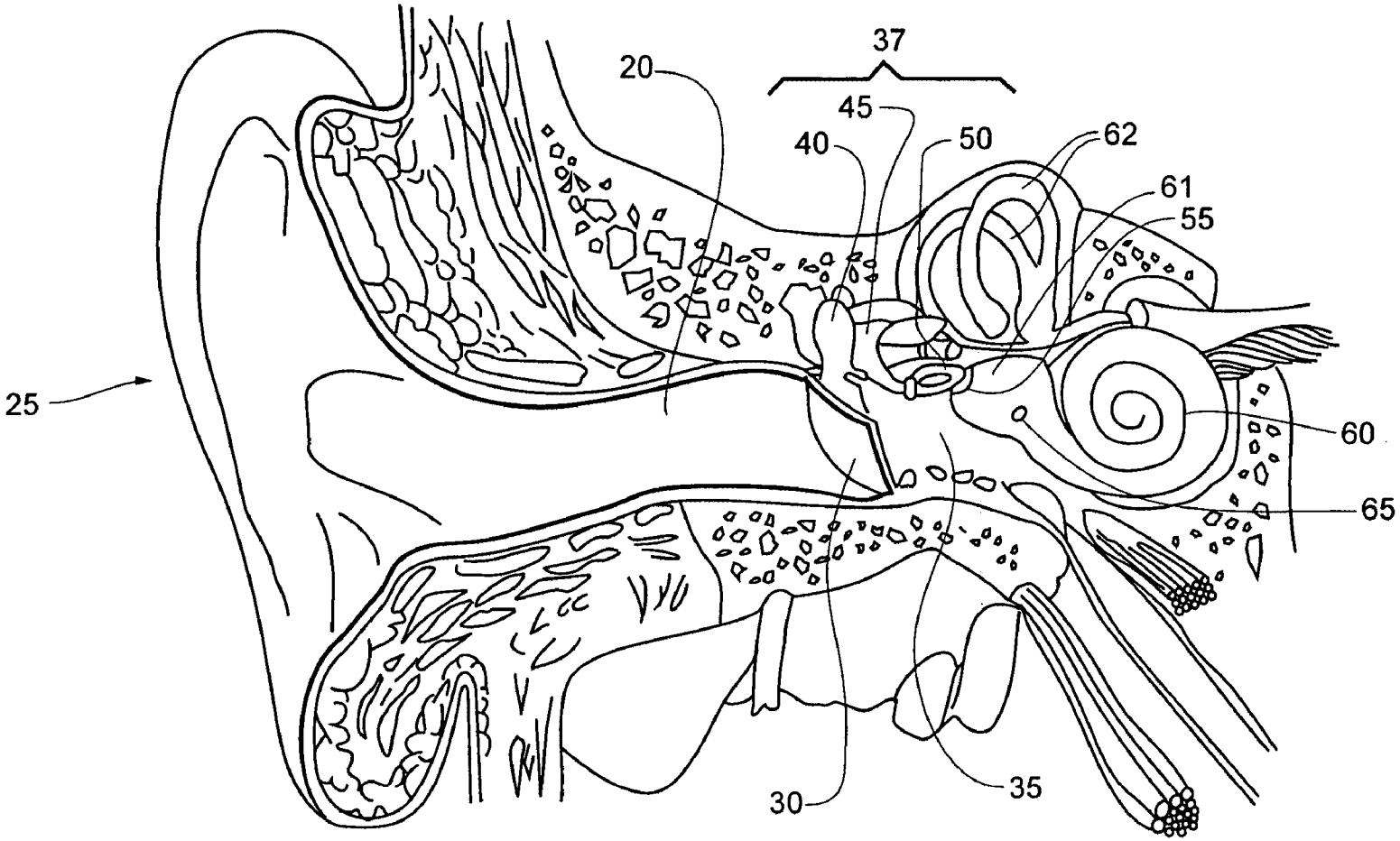
FIG. 1 illustrates a frontal section of an anatomically normal human right ear.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, and are not intended to limit the scope of the invention as defined in the claims.

Some embodiments of the invention provide an electromechanical transducer which is particularly advantageous when used in a middle ear implantable hearing aid system, such as a partial middle ear implantable (P-MEI), total middle ear implantable (T-MEI), or other hearing aid system. A P-MEI or T-MEI hearing aid system assists the human auditory system in converting acoustic energy contained within sound waves into electrochemical signals delivered to the brain and interpreted as sound.

FIG. 1 illustrates, generally, the human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the tympanic membrane (eardrum) 30, interposed at the terminus of the external auditory canal, between it and the tympanic cavity (middle ear) 35. Variations in the sound waves produce tympanic vibrations. The mechanical energy of the tympanic vibrations is communicated to the inner ear, comprising cochlea 60, vestibule 61, and semicircular canals 62, by a sequence of articulating bones located in the middle ear 35. This sequence of articulating bones is referred to generally as the ossicular chain 37. Thus, the ossicular chain transforms acoustic energy at the eardrum to mechanical energy at the cochlea 60.

The ossicular chain 37 includes three primary components: a malleus 40, an incus 45, and a stapes 50. The malleus 40 includes manubrium and head portions. The manubrium of the malleus 40 attaches to the tympanic membrane 30. The head of the malleus 40 articulates with one end of the incus 45. The incus 45 normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus 45 articulates the capitulum of the stapes 50 to complete the mechanical transmission path.

Normally, prior to implantation of the hearing aid system according to some embodiments of the invention, tympanic vibrations are mechanically conducted through the malleus 40, incus 45, and stapes 50, to the oval window 55. Vibrations at the oval window 55 are conducted into the fluid filled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain 37, and/or cochlea 60 can disrupt or impair normal hearing.

Hearing loss due to damage in the cochlea is referred to as sensorineural hearing loss. Hearing loss due to an inability to conduct mechanical vibrations through the middle ear is referred to as conductive hearing loss. Some patients have an ossicular chain 37 lacking sufficient resiliency to transmit mechanical vibrations between the tympanis membrane 30 and the oval window 55. As a result, fluidic motion in the cochlea 60 is attenuated. Thus, receptor cells in the cochlea 60 do not receive adequate mechanical stimulation. Damaged elements of ossicular chain 37 may also interrupt transmission of mechanical vibrations between the tympanic membrane 30 and the oval window 55.

Implantable hearing aid systems have been developed, utilizing various approaches to compensate for hearing disorders. For example, cochlear implant techniques implement an inner ear hearing aid system. Cochlear implants electrically stimulate auditory nerve fibers within the cochlea 60. A typical cochlear implant system may include an external microphone, an external signal processor, and an external transmitter, as well as an implanted receiver and an implanted probe. A signal processor converts speech signals transduced by the microphone into electrical stimulation that is delivered to the cochlea 60.

A particularly interesting class of hearing aid systems includes those which are configured for disposition principally within the middle ear space 35. In middle ear implantable (MEI) hearing aids, an electrical-to-mechanical output transducer couples mechanical vibrations to the ossicular chain 37, which is optionally interrupted to allow coupling of the mechanical vibrations to the ossicular chain 37. Both electromagnetic and piezoelectric output transducers have been used to effect the mechanical vibrations upon the ossicular chain 37.

One example of a partial middle ear implantable (P-MEI) hearing aid system having an electromagnetic output transducer comprises: an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus. Such electromagnetic output transducers have relatively high power consumption, which limits their usefulness in total middle ear implantable (T-MEI) hearing aid systems.

A piezoelectric output transducer is also capable of effecting mechanical vibrations to the ossicular chain 37. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed. A resulting electrical signal is provided to an electrical-to-mechanical piezoelectric output transducer that generates a mechanical vibration coupled to an element of the ossicular chain 37 or to the oval window 55 or round window 65. In the '366 patent, the ossicular chain 37 is interrupted by removal of the incus 45. Removal of the incus 45 prevents the mechanical vibrations delivered by the piezoelectric output transducer from mechanically feeding back to the piezoelectric input transducer.

Piezoelectric output transducers have several advantages over electromagnetic output transducers. The smaller size or volume of the piezoelectric output transducer advantageously eases implantation into the middle ear 35. The lower power consumption of the piezoelectric output transducer is particularly attractive for T-MEI hearing aid systems, which may include a limited longevity implanted battery as a power source.

A piezoelectric output transducer is typically implemented as a ceramic piezoelectric bi-element transducer, which is a cantilevered double plate ceramic element in which two opposing plates are bonded together such that they amplify a piezoelectric action in a direction normal to the bonding plane. Such a bi-element transducer vibrates according to a potential difference applied between the two bonded plates. A proximal end of such a bi-element transducer is typically cantilevered from a transducer mount which is secured to a temporal bone within the middle ear. A distal end of such a bi-element transducer couples mechanical vibrations to an ossicular element such as stapes 50.

Figure 2:
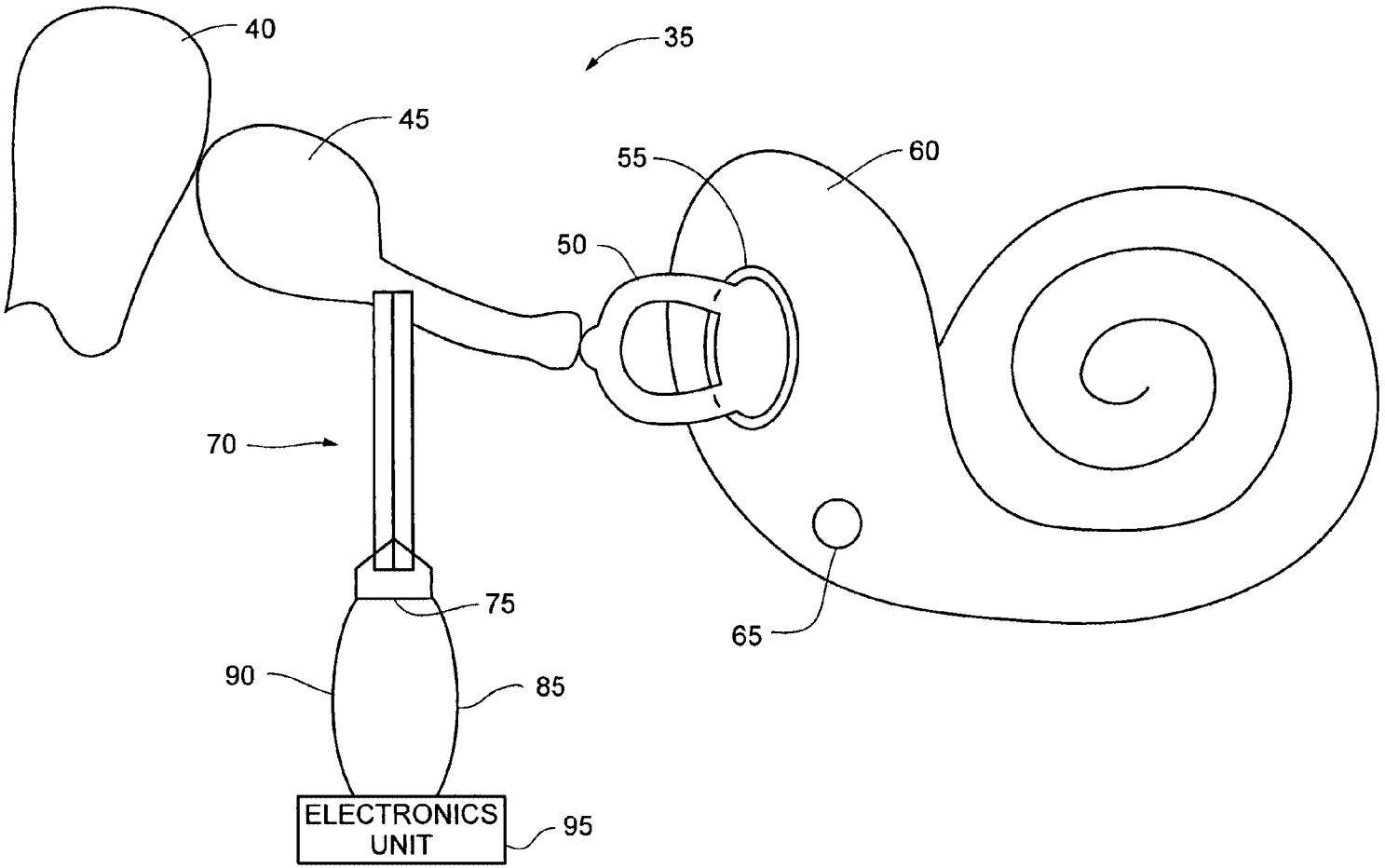
FIG. 2 is a cross-sectional illustration of a typical use of a bi-element transducer coupled to an auditory element in the middle ear.

FIG. 2 is a generalized illustration of a bi-element transducer 70 cantilevered at its proximal end from a mount 75 secured to a temporal bone within middle ear 35. A distal end of bi-element transducer 70 is mechanically coupled to an auditory element to receive or effect mechanical vibrations when operating as an input or output transducer respectively. For example, to receive mechanical vibrations as an input transducer, bi-element transducer 70 may be coupled to an auditory element such as a tympanic membrane 30 (shown in FIG. 1), malleus 40, or incus 45. In another example, to effect vibrations as an output transducer, bi-element transducer 70 may be coupled to an auditory element such as incus 45, stapes 50, oval window 55, round window 65, vestibule 61 (shown in FIG. 1), or semicircular canal 62. The transducer 70 is coupled by leads 85 and 90 to an electronics unit 95.

Figure 3:
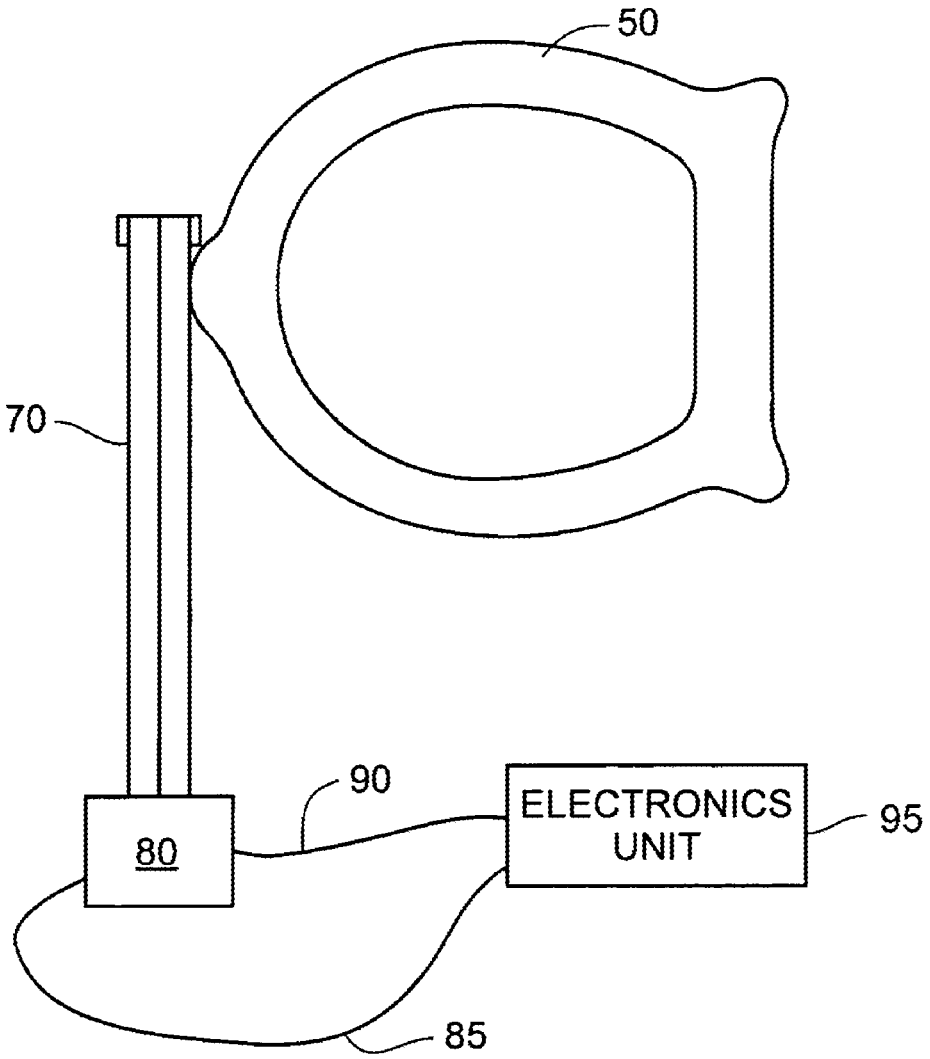
FIG. 3 is a cross-sectional illustration of a bi-element transducer secured only to a vibrated auditory element.

FIG. 3 illustrates generally a cross-sectional view of an electromechanical output transducer. A piezoelectric element, more particularly bi-element transducer 70, is mechanically coupled, and preferably secured, at its proximal end to middle ear 35 (shown in FIG. 1) through an auditory element, preferably stapes 50, or alternatively incus 45, stapes 50, oval window 55, round window 65, vestibule 61, or semicircular canals 62. Bi-element transducer 70 can be secured only to stapes 50 by any known attachment technique, including biocompatible adhesives or mechanical fasteners. For example, in one embodiment, a deformable wire (not shown) secured to the proximal end of bi-element transducer 70 is looped through an inner portion of stapes 50, for example, and crimped to secure bi-element transducer 70 to stapes 50.

Electronics unit 95 may couple an electrical signal through lead wires 85 and 90 to any convenient respective connection points on respective opposing elements of bi-element transducer 70.

In response to the electrical signals received from electronics unit 95, bi-element transducer 70 bends with respect to a longitudinal plane between its opposing elements. The bending is resisted by inertial mass 80 which may be connected to bone through the use of adhesive or bone cement or a mechanical connector, for example a screw, thus mechanically coupling a force to stapes 50 through bi-element transducer 70. This force upon stapes 50 is in turn transmitted to cochlea 60 at oval window 55.

Figure 4:
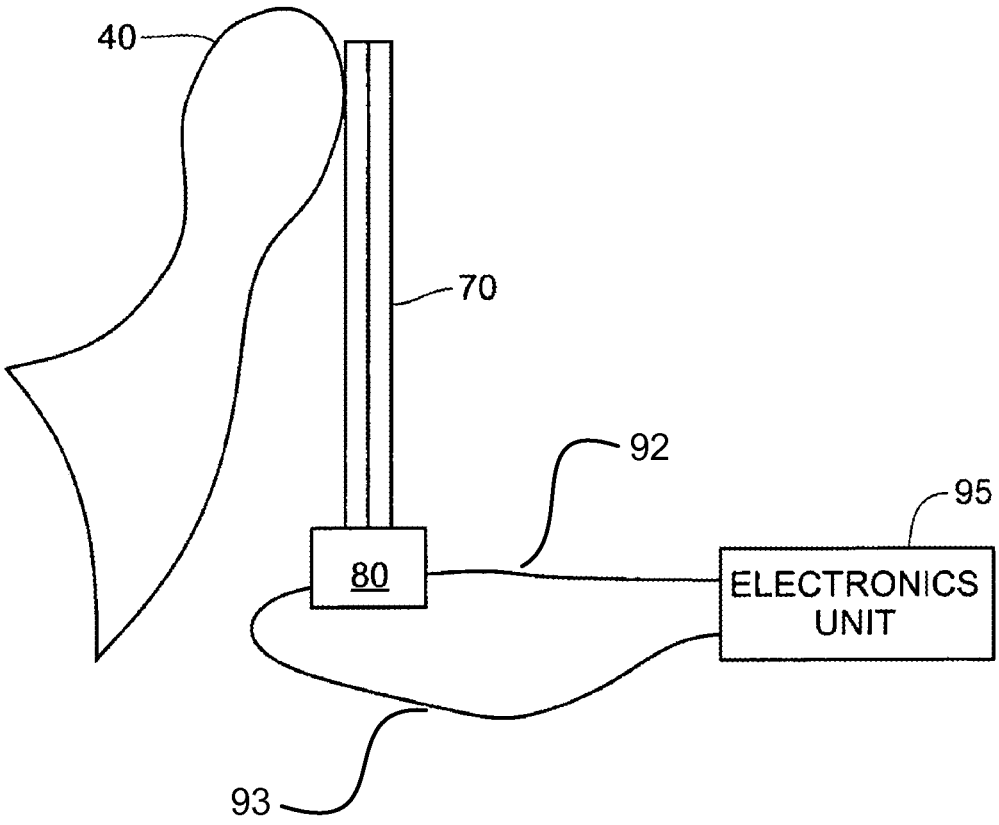
FIG. 4 is a cross-sectional illustration of a bi-element transducer secured only to a vibrating auditory element.

FIG. 4 illustrates generally a cross-sectional view of an electromechanical input transducer. A piezoelectric element, such as bi-element transducer 70, is secured by any known attachment technique at its proximal end, such as described above, for example, to malleus 40.

Bi-element transducer 70 may also be secured only to other auditory elements for receiving mechanical vibrations, such as incus 45 or tympanic membrane 30. Vibrations of malleus 40 cause, at the proximal end of bi-element transducer 70, vibratory displacements that are opposed by inertial mass 80 which may be connected to bone through the use of adhesive or bone cement or a mechanical connector, for example a screw. As a result, bi-element transducer 70 bends with respect to the longitudinal plane between its opposing elements. A resulting electrical signal is provided at any convenient connection point on respective opposing elements of bi-element transducer 70, through respective lead wires 92 and 93 to electronics unit 95.

Figure 5:
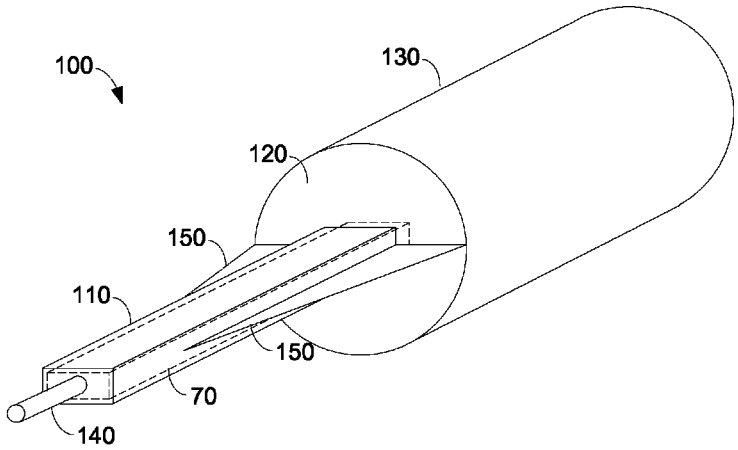
FIG. 5 is a perspective view of one embodiment of the invention.

FIG. 5 is a perspective view of one transducer assembly 100 having a bi-element transducer 70 contained within a sleeve 110. The proximal end of the sleeve 110 is connected to a diaphragm 120 which is connected to a housing 130. The diaphragm 120 allows the sleeve 110 to move with the movement of the transducer 70 as will be described in further detail hereinafter. A pin 140 may be connected, for example by welding or gluing, to the distal end of the sleeve 110. In one embodiment, the sleeve 110 has a longitudinal body with a rectangular cross section, but it may also have a circular, trapezoidal, or triangular cross section, and its longitudinal body may be trapezoidal, triangular, or circular in shape. In one embodiment, a pair of fins 150, also known as gussets, is located on an exterior surface of the sleeve 110.

The elements of the transducer assembly 100 may be made of metallic or non-metallic implantable materials that can be hermetically sealed, for example, titanium, gold, platinum, platinum-iridium, stainless steel, or plastic. In one embodiment, the transducer assembly 100 is made out of a thin-walled metallic or non-metallic material that preferably can be made to minimize spring constant and mass while providing a hermetic barrier. In another embodiment, the transducer assembly 100 has a wall thickness ranging from about 0.0005 inches to 0.01 inches and may be made by die forming, hydroforming, electro deposition, or thin film deposition. Elements of the transducer assembly 100 may be connected together by gluing, soldering, brazing, or welding, for example.

The transducer assembly 100 may also be provided with one or more coatings that may enhance the mechanical and/or biological characteristics of the devices. The coatings may be organic or inorganic and may provide one or more of the following characteristics while maintaining low spring rate and mass loading: scratch and/or moisture resistance, biocompatibility, tissue adhesion resistance, microbial resistance, for example. For instance, a medical adhesive coating or a conformal coating may be applied from a point just proximal the pin 140 to the housing 130. In one embodiment, a medical adhesive may be applied to the pin 140.

In another embodiment, the transducer assembly 100 may be formed by coating the bi-element transducer 70 with organic or inorganic coatings. Inorganic coatings may consist of a single or multiple layers of formed or deposited metals including titanium, platinum, gold, nickel, copper, palladium cobalt, for example. Organic materials may include Teflon, silicone, parylene, polyolefin, polyurethane, for example. Coatings may be applied by several well known techniques including dipping the transducer assembling in the materials, rolling it, spraying it on, vapor depositing, electrostatic, ion beam, plasma and vacuum depositing for example. The coating or coatings may also be surface modified to incorporate desired properties.

The transducer assemblies according to the embodiments described herein can be hermetically sealed to provide a fully implantable device.

Applicant has learned that vibration in the intended/primary direction is well damped by the cochlear fluid, but that the cochlea has limited damping in the lateral direction. A resonance not in the primary direction will result in large displacements due to the low damping. The large displacements can result in poor performance or mechanical feedback.

Figure 6:
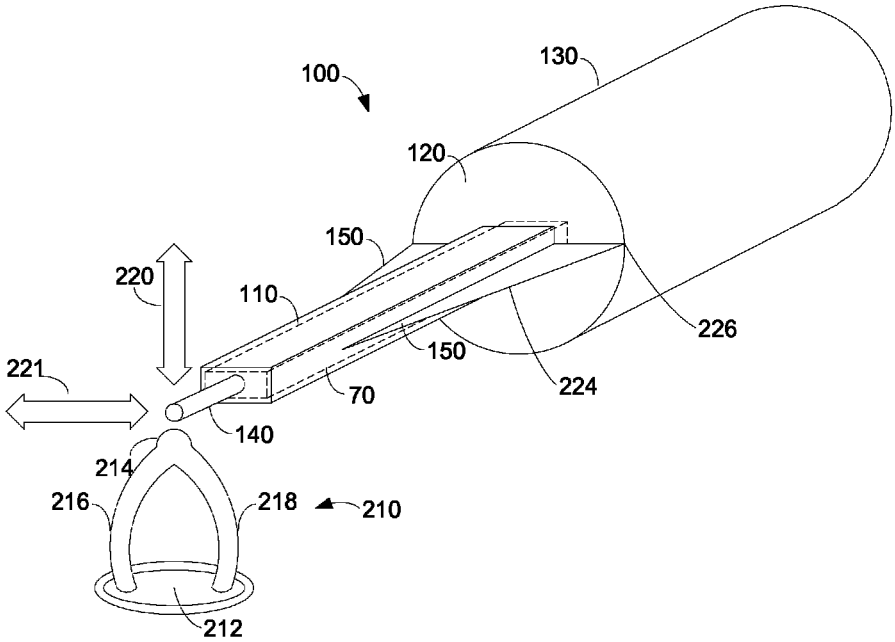
FIG. 6 is a second perspective view of an embodiment of the invention.

FIG. 6 is a perspective view of one transducer assembly 100 having a bi-element transducer 70 within sleeve 110 where the bi-element transducer 70 has a fixed region within a housing 130 and is coupled to diaphragm 120. A pin 140, which is connected to the sleeve 110, can be coupled to various parts of the ossicular chain, for example, stapes 210. Stapes 210 includes a head or capitulum 214 and two crura portions 216 and 218 which in turn are joined to footplate 212. Footplate 212 typically remains coupled to the oval window for transmitting the mechanical vibrations to the cochlea. The bi-element transducer 70 can be a piezoelectric bi-element transducer in some embodiments. The bi-element transducer 70 may generate motion in the direction shown by arrows 220. The direction of an alternate motion that may occur in the current application is indicated by arrows 221. A pair of fins 150 or gussets are coupled to sleeve 110 and diaphram 120 and lie generally in a plane. The vibration movement indicated at arrows 220 is substantially orthogonal or normal to the plane containing fins 150. In the example illustrated, fins 150 have a generally triangular shape, having an outer edge 224 and an outer corner 226. In some embodiments, the outer edge is straight, as illustrated at 224. In other embodiments, the outer edge is curved and is either convex outward or concave inward relative to the example illustrated at 224. The curved shapes may have elliptical, exponential, or other curves, depending on the embodiment. In other embodiments, the fins 150 may be a rectangular shape or they may have a varying saw-tooth shape.

Figure 7:
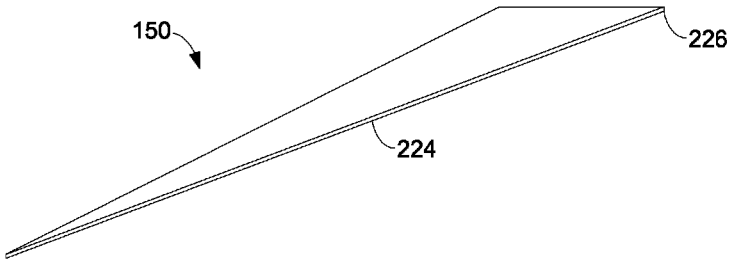
FIG. 7 is a perspective view of one fin according to the present invention.

FIG. 7 provides another view of a fin 150, including outer edge 224 and corner 226. In some embodiments, corner 226 is sharp, while in other embodiments the corner is slightly rounded. Fin 150 can be formed of 0.0020 inch thick titanium in some embodiments or it may have a greater thickness possibly as thick as sleeve 110. In some embodiments fin 150 may be solid, while in other embodiments it may be hollow.

Figure 8:
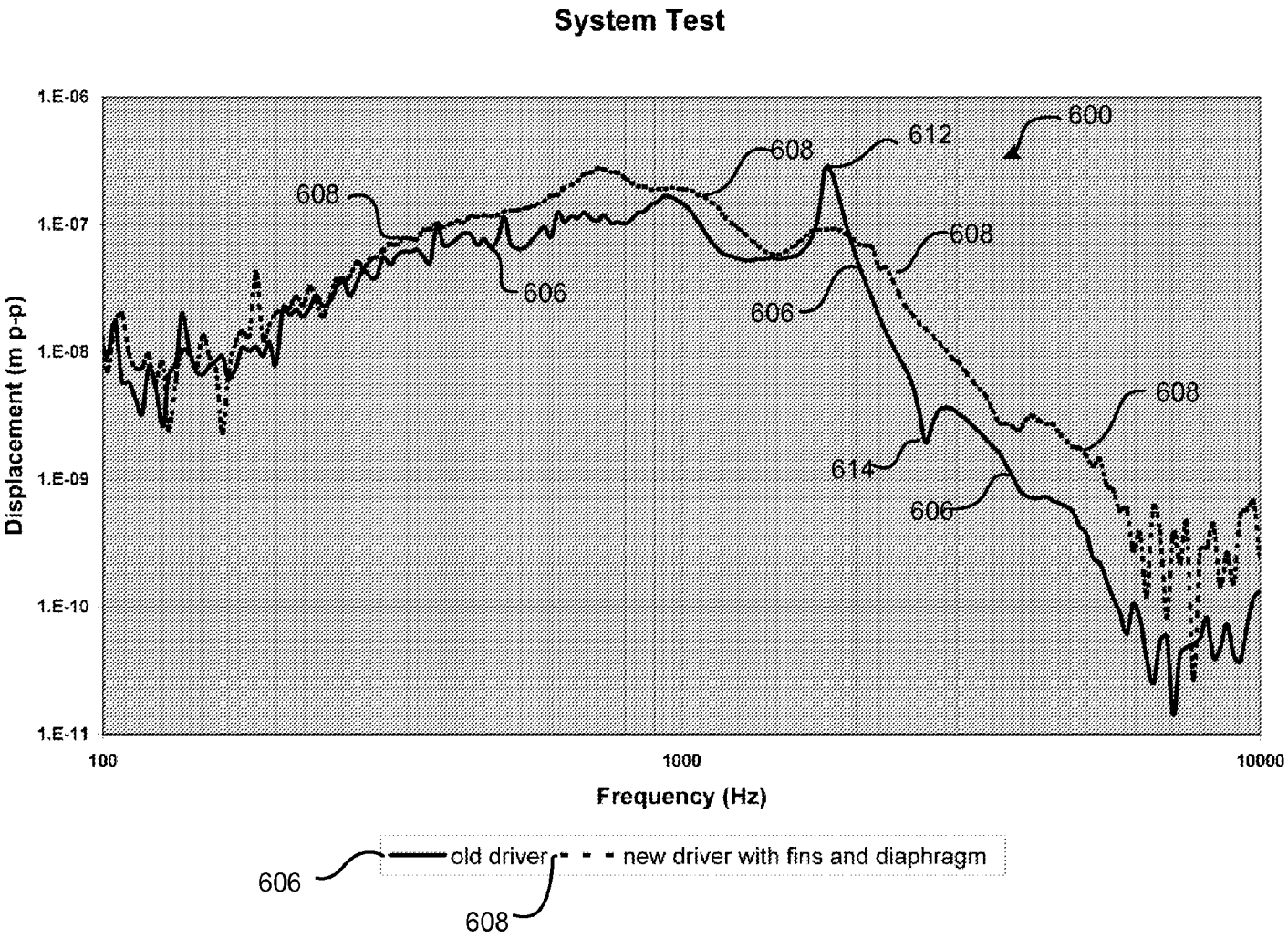
FIG. 8 is a plot showing experimental results from some embodiments of the present invention.

FIG. 8 illustrates comparative experimental results in a plot 600, with and without the fins. The X axis is the swept frequency. This is the frequency of the electrical signal feeding the transducer. The Y axis is the peak to peak displacement, from $1\times10^{-11}$ meters at bottom to $1\times10^{-6}$ meters at top. There are two different experimental results shown in lines 606 and 608. Line 606 illustrates the results without the fins, while line 608 illustrates the results with the fins in place and with a diaphragm or metallic sleeve as illustrated in FIGS. 5-6. The results were taken in different experimental runs, and having the different sleeve in addition to the fins. The gain setting for line 608 appears to be higher than that of line 606. For these reasons, the results are meant to be illustrative. Both lines increase up to about 1000 Hz, and then roll off. The older design, shown in line 606, has a peak as indicated at 612, near about 1800 Hz. This can show up as a distorted signal in the user's hearing, as the peak to peak displacement is unusually large and unnatural, given the overall downward trend of the transducer displacement above 1000 Hz. Applicant believes that this peak is near a predominate frequency in voices, which can prove to be a less than desirable attribute for conversational speech. In addition, applicant believes that this large and unnatural displacement can provide input back to a signal transducer which may be located near the eardrum in some uses of the invention. These vibrations may be transmitted through the air or through bone. The vibrations can set up a feedback loop, causing even poorer results. In some systems, the electronics may detect the distortion and/or feedback and block them out, causing a loss of signal to the user. Line 608 shows the improved results using the fins. The distortion has been significantly reduced.

Inspection of FIG. 8 shows that without the fins, there are distinct resonance peaks as indicated at 612, near about 1800 Hz. Acoustical signals are received in this frequency range at the tympanic membrane and may be converted to electrical signals by another transducer. These electrical signals can be coupled to a transducer. Rather than reproduce this frequency faithfully, the vibratory transducer may instead produce the unwanted resonance peaks at 612, which can be upsetting to the hearer. In some uses, the reproduction provided by the transducer is primarily or even the sole source of auditory signals, as portions of the middle ear may have been surgically removed in order to allow the device to work. The resonance in region 612 is clearly and significantly reduced in the example where the fins or gussets are present. An antiresonance valley 614 is shown on line 606. With the addition of fins 150 and diaphragm 120, the antiresonance valley 614 is moved to a higher frequency.

Applicant believes that the fins, wings, or gussets, allow vibration in the intended direction while reducing or controlling an apparent resonance which can be set up in a direction orthogonal to the desired direction, which distorts the desired vibratory output. Further, the combination of fins 150 and diaphragm 120 has moved the antiresonance frequency to a higher frequency thereby increasing bandwidth.

What is claimed is:

1. An implantable transducer assembly for implanting into a middle ear region, the transducer assembly comprising:

an elongate transducer configured to receive an electrical signal and produce a vibration in response to the electrical signal, in which the vibration occurs predominantly in a first plane which includes the transducer longitudinal axis;

the transducer having a length, a free vibrating end, and a fixed region opposite the free end for operable coupling to a bone; and a pair of fins operably coupled to opposite sides of the transducer, the fins having a thickness dimension, in which the fins lie in a second plane which is normal to the first plane and in which the second plane includes the transducer longitudinal axis; a base member, in which the transducer fixed region is coupled to the base member, and in which the fins each have a free edge disposed near to but uncoupled to the base member; wherein the transducer is configured to vibrate in the first plane to move the fins in a direction orthogonal to the fin thickness dimension; and wherein the fins are longitudinally triangular shaped with fin longitudinal axis being parallel to the transducer longitudinal axis.

2. The transducer assembly as in claim 1, further comprising a protective layer covering the transducer, in which the fins are not directly coupled to the transducer, in which the fins are secured to the protective layer, such that the operable coupling is made through the protective layer.

3. The transducer assembly as in claim 2, in which the protective layer includes a metallic sheet.

4. The transducer assembly as in claim 3, in which the metallic sheet is formed of titanium less than 3 mils thick.

5. The transducer assembly as in claim 1, further comprising a base member, in which the transducer fixed region is coupled to the base member, and in which the fins are not directly coupled to the base member, such that the vibrating in the first plane moves the fins in a direction orthogonal to the fin thickness dimension.

6. The transducer assembly as in claim 1, in which the fins have a triangular shape but with convex outer edges.

7. The transducer assembly as in claim 1, in which the fins have a triangular shape but with concave outer edges.

8. The transducer assembly as in claim 1, in which the fins have rounded outer edges.

9. The transducer assembly as in claim 1, in which the fins have a length at least 20 percent of the length of the transducer.

10. The transducer assembly as in claim 1, in which the fins have a length less than 80 percent of the length of the transducer.

11. The transducer assembly as in claim 1, in which the fins have a length of less than ½ inch.

12. The transducer assembly as in claim 1, in which the transducer is less than 1 inch long.

13. The transducer assembly as in claim 1, further comprising a biocompatible bone mount assembly coupled to the transducer fixed region for securing to a bone.

14. The transducer assembly as in claim 1, in which the transducer is hermitically sealed.

15. A system for treating hearing loss, the system comprising: an implantable transducer assembly for implanting into a middle ear region, the transducer assembly including: an elongate transducer configured to receive an electrical signal and produce a vibration in response to the electrical signal, in which the vibration occurs predominantly in a first plane which includes the transducer longitudinal axis;

the transducer having a length, a free vibrating end, and a fixed region opposite the free end for operable coupling to a bone; and a pair of fins operably coupled to the transducer, the fins having a thickness dimension, and in which the fins lie predominantly in a second plane which is normal to the first plane and in which the second plane includes the transducer longitudinal axis; and an implantable electronic device electrically coupled to the transducer assembly for outputting the electrical signal; a base member, in which the transducer fixed region is coupled to the base member, and in which the fins each have a free edge disposed near to but uncoupled to the base member; wherein the transducer is configured to vibrate in the first plane to move the fins in a direction orthogonal to the fin thickness dimension; and wherein the fins are longitudinally triangular shaped with fin longitudinal axis being parallel to the transducer longitudinal axis.

* * * * *